US006874316B2

(12) United States Patent
Nakatani

(10) Patent No.: US 6,874,316 B2
(45) Date of Patent: Apr. 5, 2005

(54) DEVICE FOR PURIFYING THE EXHAUST GAS OF AN INTERNAL COMBUSTION ENGINE

(75) Inventor: Koichiro Nakatani, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/419,725

(22) Filed: Apr. 22, 2003

(65) Prior Publication Data

US 2004/0083724 A1 May 6, 2004

(30) Foreign Application Priority Data

Apr. 25, 2002 (JP) ..... 2002-123864

(51) Int. Cl.[7] ..... F01N 3/00

(52) U.S. Cl. ..... 60/286; 60/288; 60/295; 60/296; 60/297

(58) Field of Search ..... 60/286, 287, 288, 60/295, 296, 297, 303, 311

(56) References Cited

U.S. PATENT DOCUMENTS 2,898,202 A * 8/1959 Eriksson et al. ..... 422/115
3,189,417 A * 6/1965 Houdry et al. ..... 422/116
6,125,629 A * 10/2000 Patchett ..... 60/286
6,182,444 B1 * 2/2001 Fulton et al. ..... 60/277
6,314,722 B1 * 11/2001 Matros et al. ..... 60/274
6,679,052 B2 * 1/2004 Nakatani et al. ..... 60/297
2004/0098979 A1 * 5/2004 Hammerle et al. ..... 60/295
2004/0107694 A1 * 6/2004 Yoshida et al. ..... 60/274

FOREIGN PATENT DOCUMENTS

| | | |
|---|---|---|
| JP | A 06-272541 | 9/1994 |
| JP | A 2000-145433 | 5/2000 |
| JP | A 2001-50034 | 2/2001 |
| JP | A 2001-115824 | 4/2001 |
| JP | A 2001-115826 | 4/2001 |
| JP | A 2001-317338 | 11/2001 |

* cited by examiner

*Primary Examiner*—Tu M. Nguyen
(74) *Attorney, Agent, or Firm*—Oliff & Berridge, PLC

(57) ABSTRACT

A device for purifying the exhaust gas of an internal combustion engine, which includes separate devices for purifying the particulates in the exhaust gas and a device for purifying $NO_x$ in the exhaust gas located integrally or separately in the exhaust system, is provided. At least two reducing material supply devices for supplying the reducing material to the device for purifying the particulates and the device for purifying $NO_x$ are arranged in the exhaust system. When the device for purifying the particulates or the device for purifying $NO_x$ requires a small amount of reducing material, one of the two reducing material supply devices supplies the required amount of reducing material to the exhaust system. When the device for purifying the particulates or the device for purifying $NO_x$ requires a large amount of reducing material, both of the two reducing material supply devices supply the required amount of reducing material to the exhaust system.

29 Claims, 11 Drawing Sheets

DEVICE FOR PURIFYING THE EXHAUST GAS OF AN INTERNAL COMBUSTION ENGINE

BACKGROUND OF THE INVENTION

1. Field of the Invention

The present invention relates to a device for purifying the exhaust gas of an internal combustion engine.

2. Description of the Related Art

The exhaust gas of a diesel engine contains particulates, comprising carbon as the chief component, and $NO_X$. It is desired that the particulates and $NO_X$ are not emitted into the atmosphere. For this reason, it has been suggested that a device for purifying the particulates and a device for purifying $NO_X$ are integrally or separately arranged in the exhaust system.

The device for purifying the particulates is one which traps the particulates. If the particulates trapped on the device are not removed, resistance to the exhaust gas therein will increase greatly. To oxidize and remove the trapped particulates, it may be required that a reducing material such as fuel is supplied to the device for purifying the particulates and to raise the temperature thereof. On the other hand, to allow the absorbed $NO_X$ to be released for reducing and purifying in the device for purifying $NO_X$, it is required that a reducing material such as fuel is supplied thereto to make the air-fuel ratio in the device be desirably stoichiometric or rich. Thus, a reducing material supply device may be provided in the exhaust system in which the particulates and $NO_X$ can be purified, as disclosed in Japanese Unexamined Patent Publication No. 2001-317338.

Of course, the reducing material supply device arranged in the exhaust system can control an amount of reducing material per unit time. By the way, the amount of reducing material per the unit time required to oxidize and remove the trapped particulates in the device for purifying the particulates is greatly different from that required to release and reduce $NO_X$ in the device for purifying $NO_X$, and they also change in accordance with an amount of exhaust gas. Namely, the reducing material supply means arranged in the exhaust system must control an amount of supplied reducing material per the unit time over a wide range and thus requires a very large range of control of the amount of supplied reducing material.

However, one reducing material supply device cannot realize such a large range of control the amount of supplied reducing material. Accordingly, even if the device can precisely control the amount of supplied reducing material in either the case that an amount of supplied reducing material per the unit time is large or in the case that it is small, it cannot precisely control the amount of supplied reducing material in both cases. The above related art also discloses that some reducing material supply devices are arranged in the exhaust system. However, even if some reducing material supply devices are arranged in the exhaust system, the required large range of control of the amount of supplied reducing material cannot be realized.

SUMMARY OF THE INVENTION

Therefore, an object of the present invention is to provide a device, for purifying the exhaust gas of an internal combustion engine comprising, integrally or separately, a device for purifying the particulates and a device for purifying $NO_X$, wherein reducing material supply means arranged in the exhaust system has a very large range of control of an amount of supplied reducing material so as to always realize the amounts of supplied reducing material, per unit time, required by the devices for purifying the particulates and $NO_X$.

A first device for purifying the exhaust gas of an internal combustion engine according to the present invention is characterized by said device comprising a device for purifying the particulates in the exhaust gas and a device for purifying $NO_X$ in the exhaust gas integrally or separately in the exhaust system, at least two reducing material supply means for supplying the reducing material to said device for purifying the particulates and said device for purifying $NO_X$ are arranged in said exhaust system, when said device for purifying the particulates or said device for purifying $NO_X$ requires a small amount of reducing material, one of said two reducing material supply means supplies the required amount of reducing material to said exhaust system, and when said device for purifying the particulates or said device for purifying $NO_X$ requires a large amount of reducing material, both of said two reducing material supply means supply the required amount of reducing material to said exhaust system.

A second device for purifying the exhaust gas of an internal combustion engine according to the present invention is characterized by that said device comprises a device for purifying the particulates in the exhaust gas and a device for purifying $NO_X$ in the exhaust gas integrally or separately in the exhaust system, at least two reducing material supply means for supplying the reducing material to said device for purifying the particulates and said device for purifying $NO_X$ are arranged in said exhaust system, when said device for purifying the particulates or said device for purifying $NO_X$ requires a small amount of reducing material, one of said two reducing material supply means supplies the required amount of reducing material to said exhaust system, and when said device for purifying the particulates or said device for purifying $NO_X$ requires a large amount of reducing material, the other of said two reducing material supply means supplies the required amount of reducing material to said exhaust system.

A third device for purifying the exhaust gas of an internal combustion engine according to the present invention is characterized in that, according to the first or second device, said two reducing material supply means are reducing material injection units, said one of said two reducing material supply means has a reducing material supply hole smaller than that of said other of said two reducing material supply means.

A fourth device for purifying the exhaust gas of an internal combustion engine according to the present invention is characterized in that, according to the first or second device, said two reducing material supply means are reducing material injection units, said one of said two reducing material supply means has a reducing material injection pressure lower than that of said other of said two reducing material supply means.

A fifth device for purifying the exhaust gas of an internal combustion engine according to the present invention is characterized in that, according to the first or second device, said one of said two reducing material supply means is a combustion heater.

A sixth device for purifying the exhaust gas of an internal combustion engine according to the present invention is characterized in that, according to any one of the first, second, third, fourth, and fifth devices, a bypass means, by which, if necessary, the exhaust gas can bypass said device for purifying $NO_X$ integrally with or separately from said device for purifying the particulate, is connected to said exhaust system via a branch portion and a joining portion, said one of said two reducing material supply means is arranged downstream of said branch portion in said exhaust system, and when $NO_X$ is released from said device for purifying $NO_X$, said bypass means makes an amount of exhaust gas passing through said device for purifying $NO_X$ decrease such that said device for purifying $NO_X$ requires said small amount of reducing material.

A seventh device for purifying the exhaust gas of an internal combustion engine according to the present invention is characterized in that, according to the sixth device, said device for purifying $NO_X$ is integral with said device for purifying the particulates.

An eighth device for purifying the exhaust gas of an internal combustion engine according to the present invention is characterized in that, according to the seventh device, said bypass means comprises a valve body in a changeover portion, when said valve body assumes a release position to open in said changeover portion, the exhaust gas bypasses said device for purifying $NO_X$ integrally with said device for purifying the particulates, when said valve body assumes a first shut-off position to shut off in said changeover portion, the upstream portion in said changeover portion is communicated with one side of said device for purifying $NO_X$, the downstream portion in said changeover portion is communicated with the other side of said device for purifying $NO_X$ and thus the exhaust gas flows in said device for purifying $NO_X$ from said one side to said other side, when said valve body assumes a second shut-off position to shut off in said changeover portion, the upstream portion in said changeover portion is communicated with said other side of said device for purifying $NO_X$, the downstream portion in said changeover portion is communicated with said one side of said device for purifying $NO_X$ and thus the exhaust gas flows in said device for purifying $NO_X$ from said other side to said one side, and said one of said two reducing material supply means is positioned to supply the reducing material to said other side of said device for purifying $NO_X$.

A ninth device for purifying the exhaust gas of an internal combustion engine according to the present invention is characterized in that said device comprises a device for purifying the particulates and $NO_X$ in the exhaust gas in the exhaust system, at least two reducing material supply means for supplying the reducing material to said device are arranged in said exhaust system, reversing means for reversing the exhaust gas upstream side and the exhaust gas downstream side of said device is provided, said reversing means comprises a valve body in a changeover portion, when said valve body assumes a release position to open in said changeover portion, the exhaust gas bypasses said device, when said valve body assumes a first shut-off position to shut off in said changeover portion, the upstream portion in said changeover portion is communicated with one side of said device, the downstream portion in said changeover portion is communicated with the other side of said device and thus the exhaust gas flows in said device from said one side to said other side, when said valve body assumes a second shut-off position to shut off in said changeover portion, the upstream portion in said changeover portion is communicated with said other side of said device, the downstream portion in said changeover portion is communicated with said one side of said device and thus the exhaust gas flows in said device from said other side to said one side, one of said two reducing material supply means is positioned between said changeover portion and said other side of said device in said exhaust system, the other of said two reducing material supply means is positioned upstream of said changeover portion in said exhaust system, when said device requires a small amount of reducing material, said one of said two reducing material supply means supplies the reducing material to said exhaust system, when said device requires a large amount of reducing material and said valve body assumes said second shut-off position, both of said two reducing material supply means supply the reducing material to said exhaust system, and when said device requires said large amount of reducing material and said valve body assumes said first shut-off position, if it is estimated that an amount of particulates smaller than a predetermined amount is emitted from said device when said valve body is changed over to said second shut-off position, both of said two reducing material supply means supply the reducing material to said exhaust system after said valve body is changed over to said second shut-off position, if it is estimated that an amount of particulates equal to or larger than said predetermined amount is emitted from said device when said valve body is changed over to said second shut-off position, said valve body is not changed over to said second shut-off position and said other of said two reducing material supply means supplies the reducing material to said exhaust system.

DESCRIPTION OF THE PREFERRED EMBODIMENT

Figure 1:
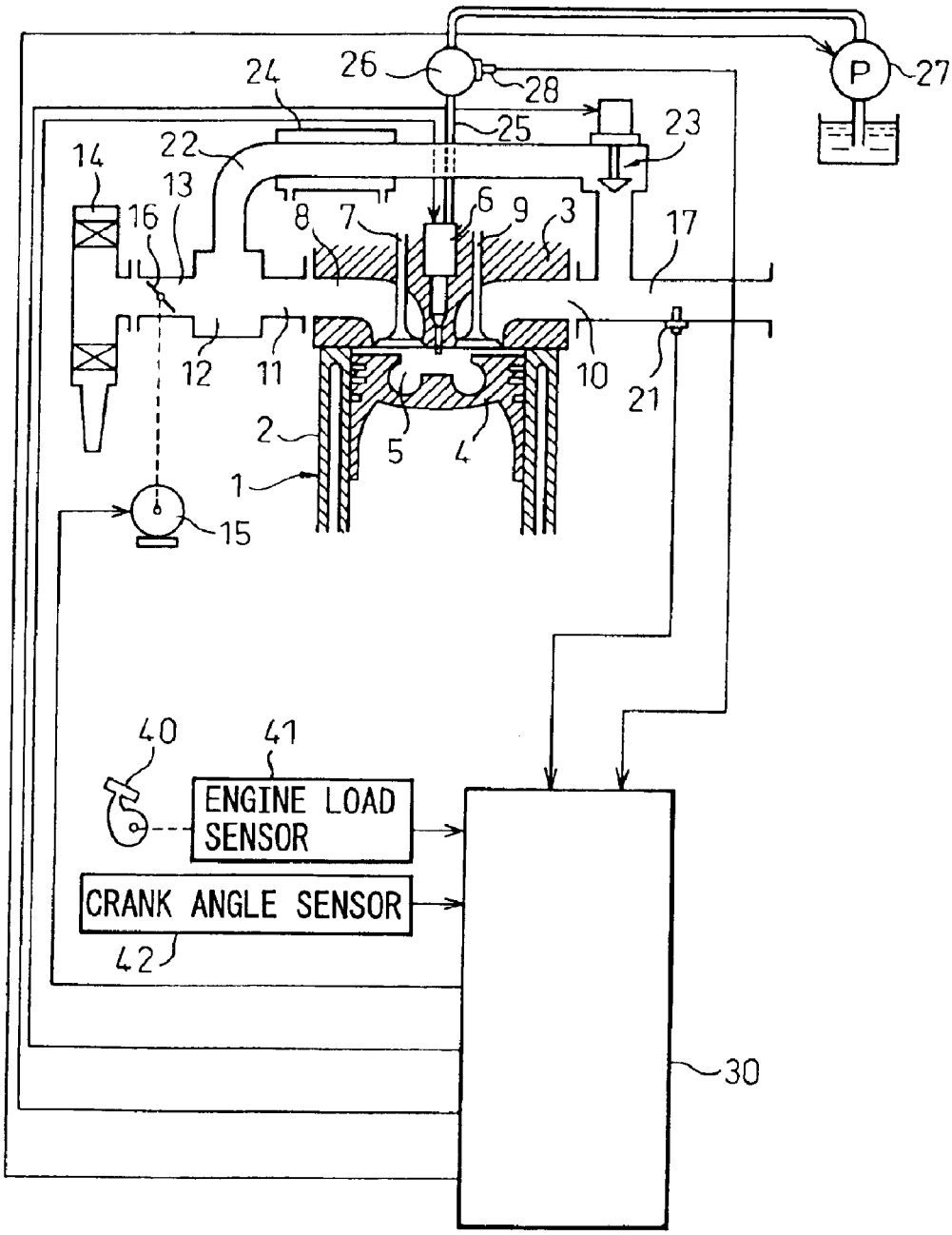
FIG. 1 is a schematic vertical sectional view of a diesel engine with a device for purifying the exhaust gas according to the present invention.

FIG. 1 is a schematic vertical sectional view of a four-stroke diesel engine with a device for purifying the exhaust gas according to the present invention. Referring FIG. 1, reference numeral 1 designates an engine body, reference numeral 2 designates a cylinder-block, reference numeral 3 designates a cylinder-head, reference numeral 4 designates a piston, reference numeral 5*a* designates a cavity formed on the top surface of piston 4, reference numeral 5 designates a combustion chamber formed in the cavity 5*a*, reference numeral 6 designates an electrically controlled fuel injector, reference numeral 7 designates a pair of intake valves, reference numeral 8 designates an intake port, reference numeral 9 designates a pair of exhaust valves, and reference numeral 10 designates an exhaust port. The intake port 8 is connected to a surge tank 12 via a corresponding intake tube 11. The surge tank 12 is connected to an air-cleaner 14 via an intake duct 13. A throttle valve 16 driven by an electric motor 15 is arranged in the intake duct 13. On the other hand, the exhaust port 10 is connected to an exhaust pipe 18 via an exhaust manifold 17.

As shown in FIG. 1, an air-fuel ratio sensor 21 is arranged in the exhaust manifold 17. The exhaust manifold 17 and the surge tank 12 are connected with each other via an EGR passage 22. An electrically controlled EGR control valve 23 is arranged in the EGR passage 22. An EGR cooler 24 is arranged around the EGR passage 22 to cool the EGR gas flowing in the EGR passage 22. In the embodiment of FIG. 1, the engine cooling water is led into the EGR cooler 24 and thus the EGR gas is cooled by the engine cooling water.

On the other hand, each fuel injector 6 is connected to the fuel reservoir, that is, a common rail 26 via a fuel supply tube 25. Fuel is supplied to the common rail 26 from an electrically controlled variable discharge fuel pump 27. Fuel supplied in the common rail 26 is supplied to the fuel injector 6 via each fuel supply tube 25. A fuel pressure sensor 28 for detecting a fuel pressure in the common rail 26 is attached to the common rail 26. The discharge amount of the fuel pump is controlled on the basis of an output signal of the fuel pressure sensor 28 such that the fuel pressure in the common rail 26 becomes the target fuel pressure.

Reference numeral 30 designates an electronic control unit. The output signals of the air-fuel sensor 21 and the fuel pressure sensor 28 are input thereto. An engine load sensor 41 is connected to the accelerator pedal 40, which generates an output voltage proportional to the amount of depression (L) of the accelerator pedal 40. The output signal of the engine load sensor 41 is also input to the electronic control unit 30. Further, the output signal of a crank angle sensor 42 for generating an output pulse each time the crankshaft rotates by, for example, 30 degrees is also input thereto. Thus, the electronic control unit actuates the fuel injector 6, the electronic motor 15, the EGR control valve 23, the fuel pump 27, and a valve body 71*a* arranged in the exhaust pipe 18 on the basis of the input signals. The valve body 71*a* will be explained in detail later.

Figure 2:
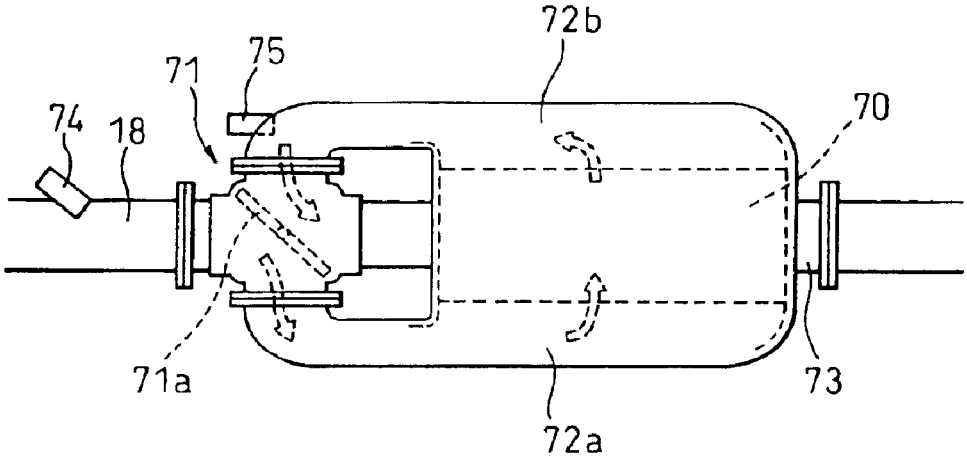
FIG. 2 is a plan view near the changeover portion and the particulate filter in the exhaust system, showing the device for purifying the exhaust gas according to the present invention.
Figure 3:
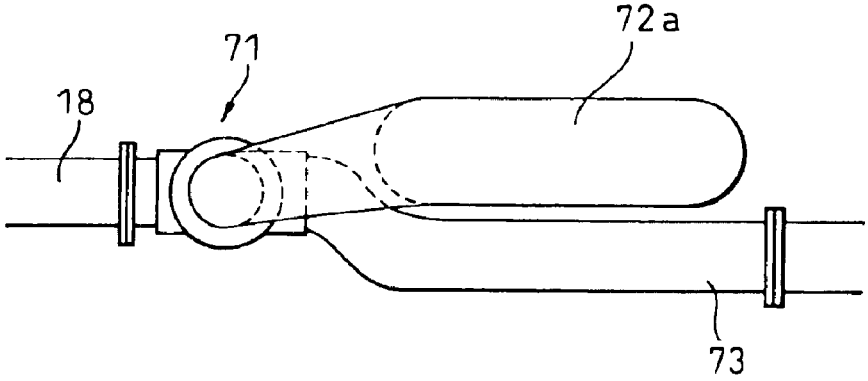
FIG. 3 is a side view of FIG. 2.

FIG. 2 is a plan view illustrating a device for purifying the exhaust gas according to the present embodiment, and FIG. 3 is a side view thereof. The device comprises a changeover portion 71 connected to the downstream of the exhaust manifold 17 via the exhaust pipe 18, a particulate filter 70, a first connecting portion 72*a* for connecting one side of the particulate filter 70 to the changeover portion 71, a second connecting portion 72*b* for connecting the other side of the particulate filter 70 to the changeover portion 71, and an exhaust passage 73 downstream of the changeover portion 71. The changeover portion 71 comprises a valve body 71*a* that shuts off the flow of exhaust gas in the changeover portion 71. The valve body 71*a* is driven by a negative pressure actuator, a step motor or the like. At a first shut-off position of the valve body 71*a*, the upstream side in the changeover portion 71 is communicated with the first connecting portion 72*a* and the downstream side therein is communicated with the second connecting portion 72*b*, and thus the exhaust gas flows from one side of the particulate filter 70 to the other side thereof as shown by arrows in FIG. 2.

Figure 4:
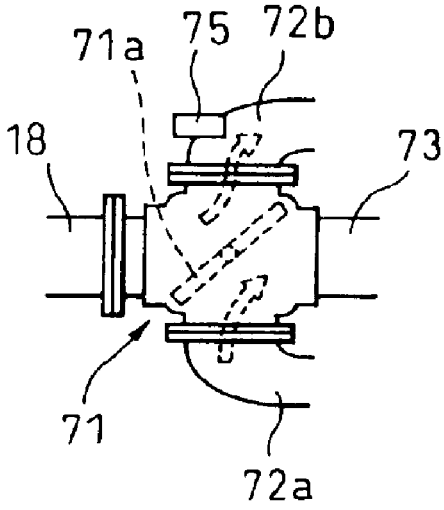
FIG. 4 is a view showing the other shut-off position of the valve body in the changeover portion that is different from that in FIG. 2.
Figure 5:
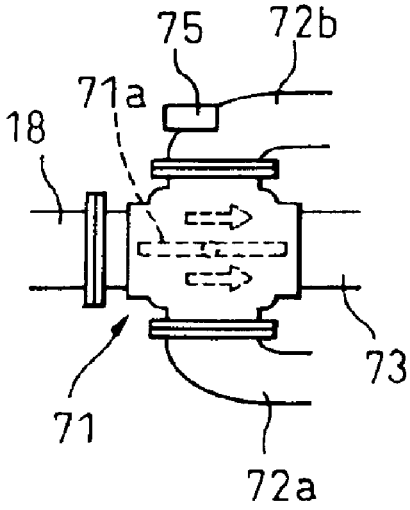
FIG. 5 is a view showing the release position of the valve body in the changeover portion.

FIG. 4 illustrates a second shut-off position of the valve body 71*a*. In this shut-off position, the upstream side in the changeover portion 71 is communicated with the second connecting portion 72*b* and the downstream side in the changeover portion 71 is communicated with the first connecting portion 72*a*, and thus the exhaust gas flows from the other side of the particulate filter 70 to the one side thereof as shown by arrows in FIG. 4. Thus, by changing over the valve body 71*a* from one of the first and second shut-off positions to the other, the direction of the exhaust gas flowing into the particulate filter 70 can be reversed, i.e., the exhaust gas upstream side and the exhaust gas downstream side of the particulate filter 70 can be reversed. Further, FIG. 5 shows a release position of the valve body 71*a* between the first shut-off position and the second shut-off position. At the release position, the changeover portion 71 is not shut off. The exhaust gas flows to bypass the particulate filter 70 as shown by arrows in FIG. 5. This means that the exhaust gas passes through a bypass passage. A general bypass passage branches from the exhaust passage, in which the particulate filter is arranged, upstream of the particulate filter via an exhaust branch portion, and joins to the exhaust passage downstream of the particulate filter via an exhaust join portion. In the present embodiment, an opening of the changeover portion 71 in the side of the exhaust pipe 18 is the exhaust branch portion, and an opening of the changeover portion 71 in the side of the exhaust passage 73 is the exhaust join portion.

In the exhaust pipe 18, a first reducing material supply unit 74, that can inject reducing material such as fuel if necessary, is arranged. In the second connecting portion 72*b*, a second reducing material supply unit 75, that can inject reducing material such as fuel if necessary, is arranged. They will be explained in detail later.

Thus, the present device for purifying the exhaust gas has the very simple structure, can reverse the exhaust gas upstream side and the exhaust gas downstream side of the particulate filter by changing over the valve body 71*a* from one of the two shut-off positions to the other, and can make the exhaust gas bypass the particulate filter 70 when the valve body 71*a* is in the release position.

Further, the particulate filter requires a large opening area to facilitate the introduction of the exhaust gas. In the device, the particulate filter having a large opening area can be used without making it difficult to mount it on the vehicle as shown in FIGS. 2 and 3.

Figure 6A:
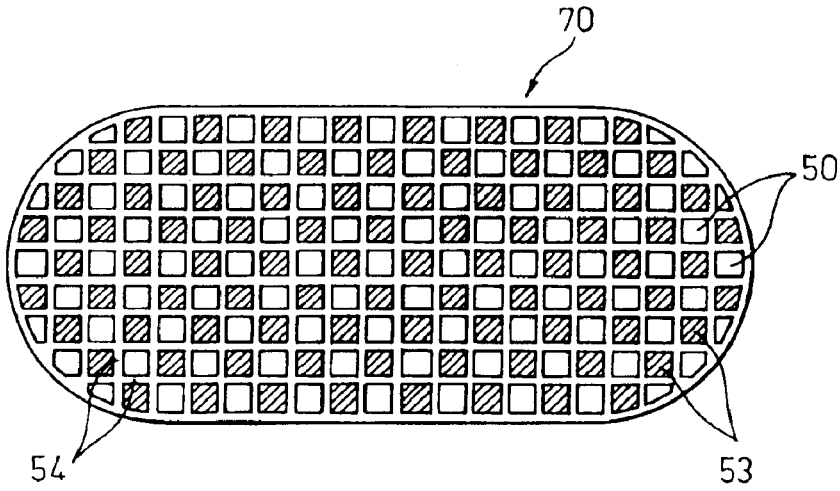
FIG. 6(A) and FIG. 6(B) are views showing the structure of the particulate filter.
Figure 6B:
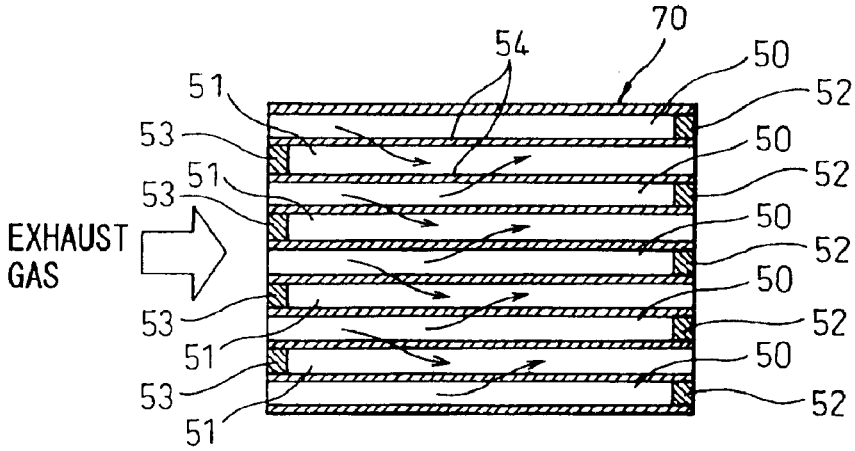

FIG. 6 shows the structure of the particulate filter 70, wherein FIG. 6(A) is a front view of the particulate filter 70 and FIG. 6(B) is a side sectional view thereof. As shown in these figures, the particulate filter 70 has an elliptic shape, and is, for example, a wall-flow type of a honeycomb structure formed of a porous material such as cordierite, and has many spaces in the axial direction divided by many partition walls 54 extending in the axial direction. One of any two neighboring spaces is closed by a plug 53 on the exhaust gas downstream side, and the other one is closed by a plug 53 on the exhaust gas upstream side. Thus, one of the two neighboring spaces serves as an exhaust gas flow-in passage 50 and the other one serves as an exhaust gas flow-out passage 51, causing the exhaust gas to necessarily pass through the partition wall 54 as indicated by arrows in FIG. 6(B). The particulates contained in the exhaust gas are much smaller than the pores of the partition wall 54, but they collide with and are trapped on the exhaust gas upstream side surface of the partition wall 54 and the pores surface in the partition wall 54. Thus, each partition wall 54 works as a trapping wall for trapping the particulates. In the present particulate filter 70, in order to oxidize and remove the trapped particulates, an active-oxygen releasing agent and a noble metal catalyst, which will be explained below, are carried on both side surfaces of the partition wall 54 and preferably also on the pore surfaces in the partition wall 54.

The active-oxygen releasing agent releases active-oxygen to promote the oxidation of the particulates and, preferably, takes in and holds oxygen when excessive oxygen is present in the surroundings and releases the held oxygen as active-oxygen when the oxygen concentration in the surroundings drops.

As the noble metal catalyst, platinum Pt is usually used. As the active-oxygen releasing agent, there is used at least one selected from alkali metals such as potassium K, sodium Na, lithium Li, cesium Cs, and rubidium Rb, alkali earth metals such as barium Ba, calcium Ca, and strontium Sr, rare earth elements such as lanthanum La and yttrium Y, and transition metals.

As an active-oxygen releasing agent, it is desired to use an alkali metal or an alkali earth metal having an ionization tendency stronger than that of calcium Ca, i.e., to use potassium K, lithium Li, cesium Cs, rubidium Rb, barium Ba, or strontium Sr.

Next, explained below is how the trapped particulates on the particulate filter are oxidized and removed, by the particulate filter carrying such an active-oxygen releasing agent, with reference to the case of using platinum Pt and potassium K. The particulates are oxidized and removed in the same manner even by using another noble metal and another alkali metal, an alkali earth metal, a rare earth element, or a transition metal.

In a diesel engine, combustion usually takes place in an excess air condition and, hence, the exhaust gas contains a large amount of excess air. That is, if the ratio of the air to the fuel supplied to the intake system and to the combustion chamber is referred to as an air-fuel ratio of the exhaust gas, the air-fuel ratio is lean. Further, NO is generated in the combustion chamber and, hence, the exhaust gas contains NO. Further, the fuel contains sulfur S and sulfur S reacts with oxygen in the combustion chamber to form $SO_2$. Accordingly, an exhaust gas containing excessive oxygen, NO, and $SO_2$ flows into the exhaust gas upstream side of the particulate filter 70.

Figure 7A:
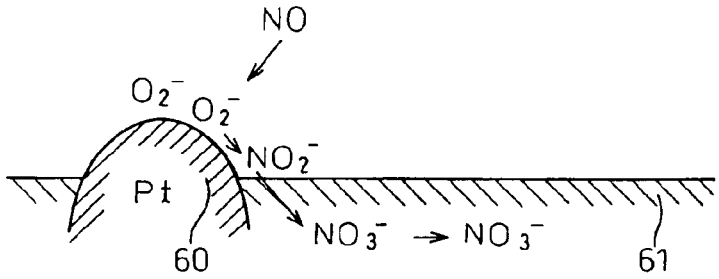
FIG. 7(A) and FIG. 7(B) are views explaining the oxidizing action of the particulate.
Figure 7B:
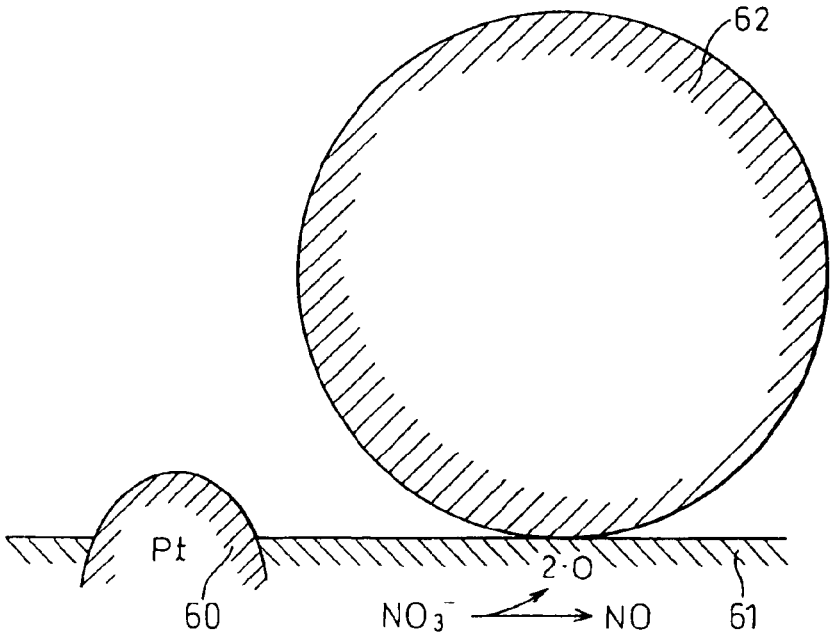

FIGS. 7(A) and 7(B) are enlarged views schematically illustrating the surface of the particulate filter 70 with which the exhaust gas comes in contact. In FIGS. 7(A) and 7(B), reference numeral 60 denotes a particle of platinum Pt and 61 denotes the active-oxygen releasing agent containing potassium K.

As described above, the exhaust gas contains a large amount of excess oxygen. When the exhaust gas contacts the exhaust gas contact surface of the particulate filter, oxygen $O_2$ adheres onto the surface of platinum Pt in the form of $O_2^-$ or $O^{2-}$ as shown in FIG. 7(A). On the other hand, NO in the exhaust gas reacts with $O_2^-$ or $O^{2-}$ on the surface of platinum Pt to produce $NO_2$ ($2NO+O_2 \rightarrow 2NO_2$). Next, a part of the produced $NO_2$ is absorbed in the active-oxygen releasing agent 61 while being oxidized on platinum Pt, and diffuses into the active-oxygen releasing agent 61 in the form of nitric acid ion $NO_3^-$ while being combined with potassium K to form potassium nitrate $KNO_3$ as shown in FIG. 7(A). Thus, in the present embodiment, $NO_X$ contained in the exhaust gas is absorbed in the particulate filter 70 and the amount thereof released into the atmosphere can be greatly decreased.

Further, the exhaust gas contains $SO_2$, as described above, and $SO_2$ also is absorbed in the active-oxygen releasing agent 61 due to a mechanism similar to that of the case of NO. That is, as described above, oxygen $O_2$ adheres onto the surface of platinum Pt in the form of $O_2^-$ or $O^{2-}$, and $SO_2$ in the exhaust gas reacts with $O^{2-}$ or $O^{2-}$ on the surface of platinum Pt to produce $SO_3$. Next, a part of the produced $SO_3$ is absorbed in the active-oxygen releasing agent 61 while being oxidized on the platinum Pt and diffuses in the active-oxygen releasing agent 61 in the form of sulfuric acid ion $SO_4^{2-}$ while being combined with potassium K to produce potassium sulfate $K_2SO_4$. Thus, potassium nitrate $KNO_3$ and potassium sulfate $K_2SO_4$ are produced in the active-oxygen releasing agent 61.

The particulates in the exhaust gas adhere onto the surface of the active-oxygen releasing agent 61 carried by the particulate filter 70 as designated at 62 in FIG. 7(B). At this time, the oxygen concentration drops on the surface of the active-oxygen releasing agent 61 with which the particulates 62 make contact. As the oxygen concentration drops, there occurs a difference in the concentration from the active-oxygen releasing agent 61 having a high oxygen concentration and, thus, oxygen in the active-oxygen releasing agent 61 tends to migrate toward the surface of the active-oxygen releasing agent 61 with which the particulates 62 make contact. As a result, potassium nitrate $KNO_3$ produced in the active-oxygen releasing agent 61 is decomposed into potassium K, oxygen O and NO, whereby oxygen O migrates toward the surface of the active-oxygen releasing agent 61 with which the particulates 62 make contact, and NO is emitted to the external side from the active-oxygen releasing agent 61. NO emitted to the external side is oxidized on platinum Pt on the downstream side and is absorbed again in the active-oxygen releasing agent 61. Of course, when an air-fuel ratio in the surroundings of the particulate filter 70 is stoichiometric or rich, active-oxygen and NO are also released from the active-oxygen releasing agent.

On the other hand, oxygen O migrating toward the surface of the active-oxygen releasing agent 61 with which the particulates 62 make contact is the one decomposed from such compounds as potassium nitrate $KNO_3$. Oxygen O decomposed from the compound has a high level of energy and exhibits a very high activity. Therefore, oxygen migrating toward the surface of the active-oxygen releasing agent 61 with which the particulates 62 make contact is active-oxygen O. Upon coming into contact with active-oxygen O, the particulates 62 are oxidized without producing luminous flame in a short time such as, for example, a few minutes or a few tens of minutes. Further, active-oxygen to oxidize the particulates 62 is also released when NO is absorbed in the active-oxygen releasing agent 61. That is, it can be considered that $NO_X$ diffuses in the active-oxygen releasing agent 61 in the form of nitric acid ion $NO_3^-$ while being combined with an oxygen atom and to be separated from an oxygen atom, and during this time, active-oxygen is produced. The particulates 62 are also oxidized by this active-oxygen. Further, the particulates adhered onto the particulate filter 70 are not oxidized only by active-oxygen, but also by oxygen contained in the exhaust gas.

The higher the temperature of the particulate filter becomes, the more the platinum Pt and the active-oxygen releasing agent 61 are activated. Therefore, the higher the temperature of the particulate filter becomes, the larger an amount of active-oxygen O released from the active-oxygen releasing agent 61 per a unit time becomes. Further, naturally, the higher the temperature of particulate is, the easier the particulates are to oxidize. Therefore, the amount of particulates that can be oxidized and removed without producing luminous flame on the particulate filter per a unit time increases along with an increase of the temperature of the particulate filter.

Figure 8:
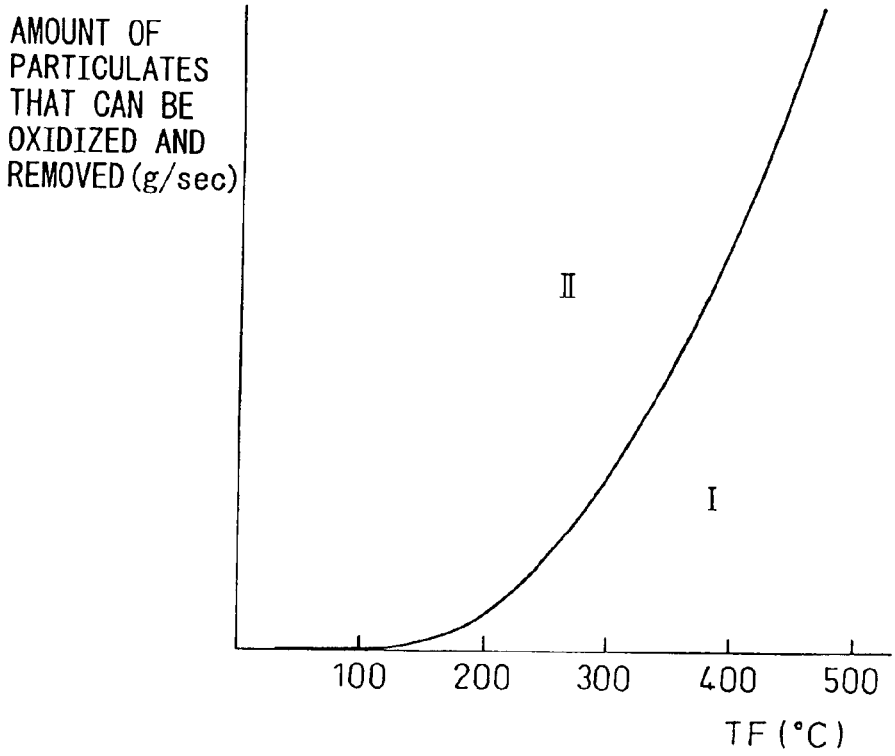
FIG. 8 is a view showing the relationship between the amount of particulates that can be oxidized and removed and the temperature of the particulate filter.

The solid line in FIG. 8 shows the amount of particulates (G) that can be oxidized and removed without producing luminous flame per unit time. In FIG. 8, the abscissa represents the temperature (TF) of the particulate filter. Here, FIG. 8 shows the case that the unit time is 1 second, that is, the amount of particulates (G) that can be oxidized and removed per 1 second. However, any time such as 1 minute, 10 minutes, or the like can be selected as unit time. For example, in the case that 10 minutes is used as a unit time, the amount of particulates (G) that can be oxidized and removed per a unit time represents the amount of particulates (G) that can be oxidized and removed per 10 minutes. In this case also, the amount of particulates (G) that can be oxidized and removed without producing luminous flame increases along with the increase of the temperature of particulate filter 70 as shown in FIG. 8.

Figure 9A:
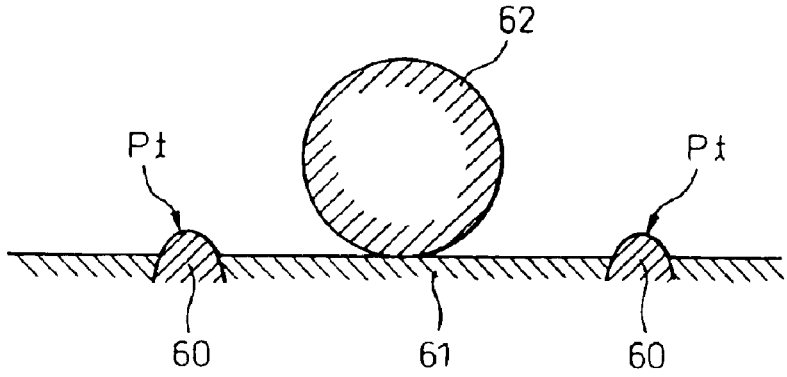
FIG. 9(A), FIG. 9(B), and FIG. 9(C) are views explaining the depositing action of the particulate.
Figure 9B:
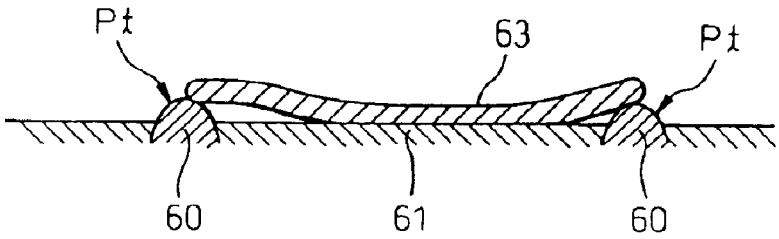
Figure 9C:
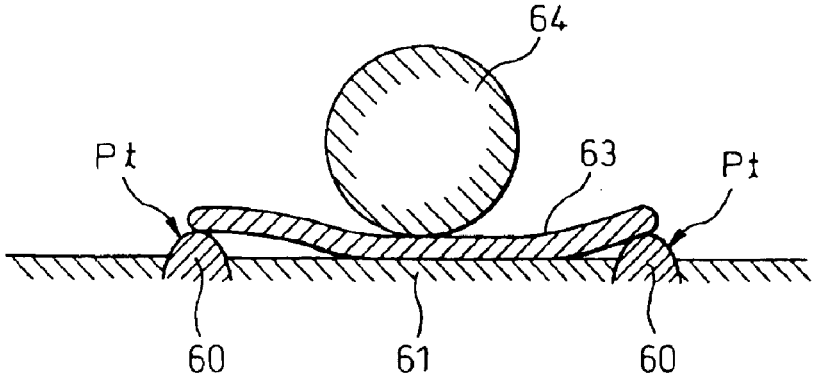

The amount of particulates emitted from the combustion chamber per unit time is referred to as an amount of emitted particulates (M). When the amount of emitted particulates (M) is smaller than the amount of particulates (G) that can be oxidized and removed, for example, the amount of emitted particulates (M) per 1 second is smaller than the amount of particulates (G) that can be oxidized and removed per 1 second or the amount of emitted particulates (M) per 10 minutes is smaller than the amount of particulates (G) that can be oxidized and removed per 10 minutes, that is, in the area (I) of FIG. 8, the particulates emitted from the combustion chamber are all oxidized and removed successively without producing luminous flame on the particulate filter 70 in a short time. On the other hand, when the amount of emitted particulates (M) is larger than the amount of particulates that can be oxidized and removed (G), that is, in the area (II) of FIG. 8, the amount of active-oxygen is not sufficient for all particulates to be oxidized and removed successively. FIGS. 9(A) to (C) illustrate the manner of oxidation of the particulates in such a case.

That is, in the case that the amount of active-oxygen is lacking for oxidizing all particulates, when the particulates 62 adhere onto the active-oxygen releasing agent 61, only a part of particulates is oxidized as shown in FIG. 9(A), and the other part of particulates that was not oxidized sufficiently remains on the exhaust gas upstream surface of the particulate filter. When the state where the amount of active-oxygen is lacking continues, a part of particulate that was not oxidized remains on the exhaust gas upstream surface of the particulate filter in succession. As a result, the exhaust gas upstream surface of the particulate filter is covered with the residual particulates 63 as shown in FIG. 9(B).

The residual particulates 63 are gradually transformed into carbonaceous matter that can hardly be oxidized. Further, when the exhaust gas upstream surface is covered with the residual particulates 63, the action of platinum Pt for oxidizing NO and SO2, and the action of the active-oxygen releasing agent 61 for releasing active-oxygen are suppressed. The residual particulates 63 can be gradually oxidized over a relative long period. However, as shown in FIG. 9(C), other particulates 64 deposit on the residual particulates 63 one after the other, and when the particulates are deposited so as to laminate, even if they are easily oxidized particulates, these particulates may not be oxidized as these particulates are separated away from platinum Pt or from the active-oxygen releasing agent. Accordingly, other particulates deposit successively on these particulates 64. That is, when the state where the amount of emitted particulates (M) is larger than the amount of particulates that can be oxidized and removed (G) continues, the particulates deposit to laminate on the particulate filter.

Thus, in the area (I) of FIG. 8, the particulates are oxidized and removed without producing luminous flame in the short time and in the area (II) of FIG. 8, the particulates are deposited to laminate on the particulate filter. Therefore, the deposition of the particulates on the particulate filter can be prevented if the relationship between the amount of emitted particulates (M) and the amount of particulates that can be oxidized and removed (G) is in the area (I). As a result, a pressure loss of the exhaust gas in the particulate filter hardly changes and is maintained at a minimum pressure loss value that is nearly constant. Thus, a decrease of the engine output can be maintained as low as possible. However, this is not always realized, and the particulates may deposit on the particulate filter if nothing is done.

Figure 10:
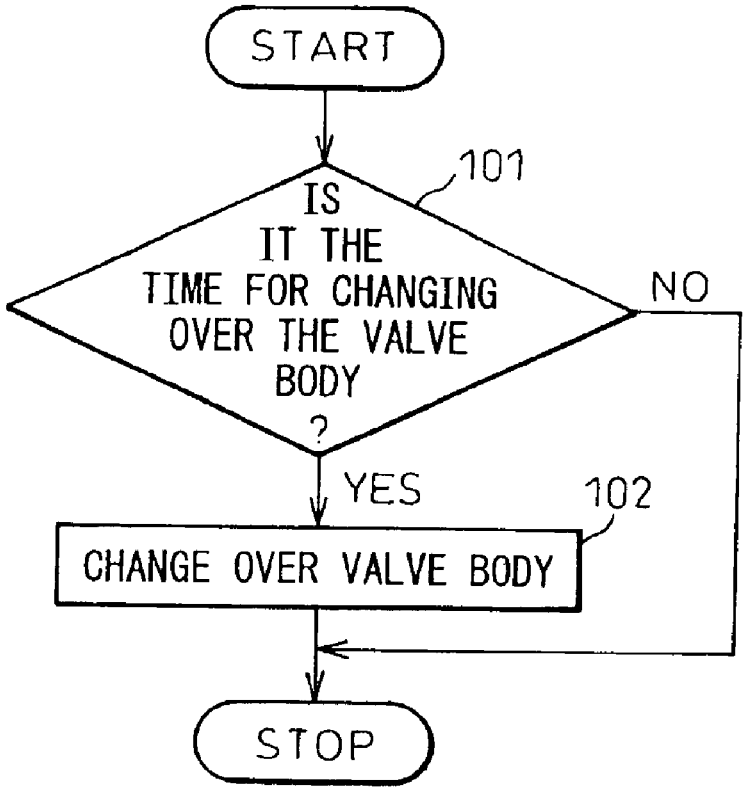
FIG. 10 is a flowchart for preventing the large deposition of the particulate on the particulate filter.

In the present embodiment, to prevent the deposition of particulates on the particulate filter, the above electronic control unit 30 controls the valve body 71*a* according to a flowchart shown in FIG. 10. The present flowchart is repeated every a predetermined time. At step 101, it is determined if it is the time for changing over the valve body 71*a*. This time occurs every set period or every set integration running distance. When the result at step 101 is negative, the routine is stopped. However, when the result is positive, the routine goes to step 102. At step 102, the valve body 71*a* is pivoted from the present shut-off position to the other shut-off position, that is, the upstream side and the downstream side of the particulate filter are reversed.

Figure 11A:
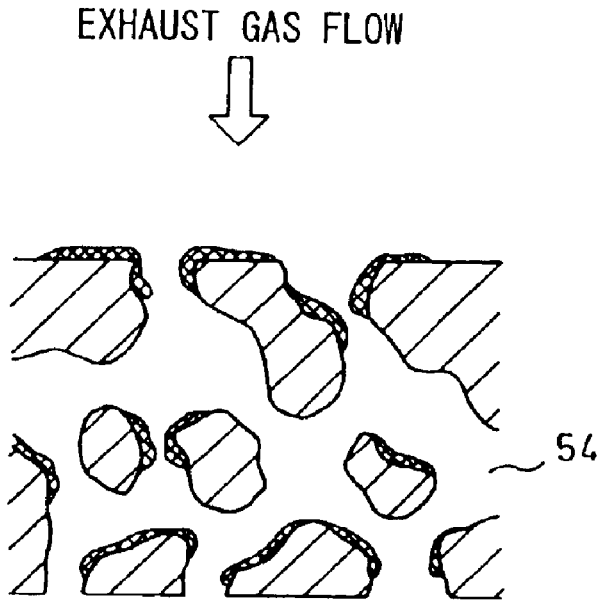
FIG. 11(A) and FIG. 11(B) are enlarged sectional views of the partition wall of the particulate filter.
Figure 11B:
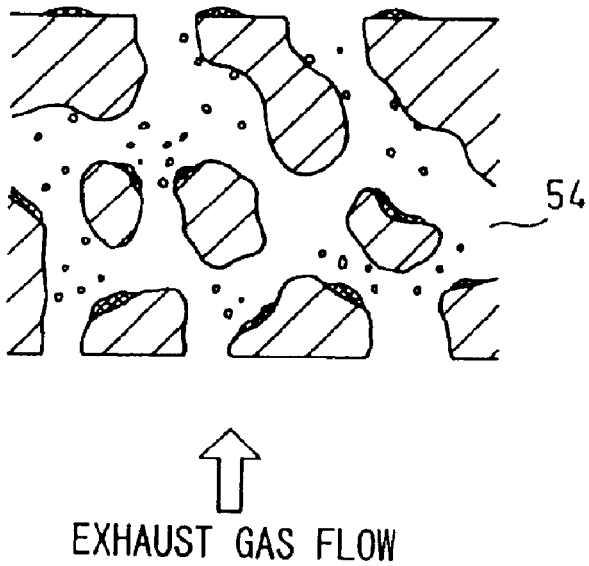

FIG. 11 is an enlarged sectional view of the partition wall 54 of the particulate filter. As mentioned above, the particulates collide with and are trapped by the exhaust gas upstream surface of the partition wall 54 and the exhaust gas opposing surface in the pores therein, i.e., one of the trapping surfaces of the partition wall 54, and are oxidized and removed by active-oxygen released from the active-oxygen releasing agent. However, the engine can be operated in the area (II) of FIG. 8 during the set period or the set integration running distance and thus the particulates can remain due to the insufficient oxidization as shown in FIG. 11(A) by grid lines. At this stage, the exhaust resistance of the particulate filter does not have a bad influence on the operation of the vehicle. However, if more particulates deposit, problems in which the engine output drops considerably, the large amount of deposited particulates ignites and burns at once to melt the particulate filter by the burned heat thereof, and the like occur. If at this stage, the upstream side and the downstream side of the particulate filter are reversed as mentioned above, no particulates deposit again on the residual particulates on one of the trapping surfaces of the partition wall and thus the residual particulates can be gradually oxidized and removed by active-oxygen released from the one of the trapping surfaces. Further, in particular, the residual particulates in the pores in the partition wall are easily smashed into fine pieces by the exhaust gas flow in the reverse direction as shown in FIG. 11(B), and they mainly move through the pores toward the downstream side.

Accordingly, many of the particulates smashed into fine pieces diffuse in the pore in the partition wall, and they contact directly the active-oxygen releasing agent carried on the pores surface and are oxidized and removed are improved. Thus, if the active-oxygen releasing agent is also carried on the pores surface in the partition wall, the residual particulates can be very easily oxidized and removed. On the other trapping surface that is now on the upstream side as the flow of the exhaust gas is reversed, i.e., the exhaust gas upstream surface of the partition wall 54 and the exhaust gas oppose surface in the pores therein to which the exhaust gas mainly impinges (of the oppose side of one of the trapping surfaces), the particulates in the exhaust gas adhere newly thereto and are oxidized and removed by active-oxygen released from the active-oxygen releasing agent. In this oxidization, a part of the active-oxygen released from the active-oxygen releasing agent on the other trapping surface moves to the downstream side with the exhaust gas, and it is made to oxidize and remove the particulates that still remain on one of the trapping surfaces despite of the reversal flow of the exhaust gas.

That is, the residual particulates on one of the trapping surfaces is exposed not only to active-oxygen released from this trapping surface but also to the remainder of the active-oxygen used for oxidizing and removing the particulates on the other trapping surface by reversing the flow of the exhaust gas. Therefore, even if some degree of particulates deposit to laminate on one of the trapping surfaces of the partition wall of the particulate filter when reversing the exhaust gas, active-oxygen arrives at the deposited particulate and no particulates deposit again on the deposited particulate due to the reversal flow of the exhaust gas and thus the deposited particulate is gradually oxidized and removed and it can be oxidized and removed sufficiently for some period until the next reversing of the exhaust gas. Of course, by alternately using the one trapping surface and the other trapping surface of the partition wall, the amount of trapped particulate on each trapping surface is smaller than that of a particulate filter in which the single trapping surface always traps the particulates. This facilitates oxidizing and removing the trapped particulates on the trapping surface.

The valve body may not be changed regularly over every set period or set integration running distance, but may be changed over irregularly. The valve body may be changed over every engine deceleration. When it is to be determined that the engine is been decelerating, the detection of the operation in which the driver intends to decelerate the engine, for example, the release of the accelerator pedal, the depression of the brake pedal, the fuel-cut or the like can be utilized. In the present embodiment, when the valve body 71*a* is changed over from one of the first and second shut-off positions to the other, the valve body 71*a* passes through the release position and at this time, a part of the exhaust gas bypasses the particulate filter 70. However, in the engine deceleration, an amount of injected fuel is very small or a fuel-cut is carried out and thus, particulates are almost not produced. Accordingly, a large amount of particulates is not emitted into the atmosphere.

Besides, when an amount of particulates deposited on the particulate filter reaches a predetermined amount, the valve body may be changed over. In an estimation of an amount of deposited particulates, the difference in pressure between the exhaust gas immediately upstream side and the exhaust gas immediately downstream side of the particulate filter 70 can be utilized. This difference in pressure increases along with an increase of an amount of deposited particulates. Further, electric resistance on a predetermined partition wall of the particulate filter may be utilized. This electric resistance drops along with an increase of an amount of deposited particulates. A transmissivity or reflectivity of light on a predetermined partition wall of the particulate filter may be utilized. The transmissivity or reflectivity drops along with an increase of an amount of deposited particulates. Besides, on the basis of the graph in FIG. 8, the difference (M−G) between the amount of emitted particulates (M) estimated by the current engine operating condition and the amount of particulates that can be oxidized and removed (G) estimated by the current engine operating condition may be integrated to give an amount of deposited particulates.

Further, when the air-fuel ratio of the exhaust gas is made rich, i.e., when the oxygen concentration in the exhaust gas is decreased, active-oxygen O is released at one time from the active-oxygen releasing agent 61 to the outside. Therefore, the deposited particulates become particulates that are easily oxidized by the active-oxygen O released at one time and thus they can be easily oxidized and removed. On the other hand, when the air-fuel ratio is maintained lean in the surroundings of the particulate filter, the surface of platinum Pt is covered with oxygen, that is, oxygen contamination is caused. When such oxygen contamination is caused, the oxidization action to $NO_X$ of platinum Pt drops and thus the absorbing efficiency of $NO_X$ drops. Therefore, the amount of active-oxygen released from the active-oxygen releasing agent 61 decreases. However, the air-fuel ratio is made rich, oxygen on the surface of Platinum Pt is consumed and thus the oxygen contamination is cancelled. Accordingly, when the air-fuel ratio is changed over from rich to lean again, the oxidization action to $NO_X$ becomes strong and thus the absorbing efficiency rises. Therefore, the amount of active-oxygen released from the active-oxygen releasing agent 61 increases.

Thus, when the air-fuel ratio is maintained lean, if the air-fuel ratio is changed over from lean to rich once in a while, the oxygen contamination of platinum Pt is cancelled every this time and thus the amount of released active-oxygen increases when the air-fuel ratio is lean. Therefore, the oxidization action of the particulate on the particulate filter 70 can be promoted. Further, the result of the cancellation of the oxygen contamination is that the reducing agent burns and thus the burned heat thereof raises the temperature of the particulate filter. Therefore, the amount of particulates that can be oxidized and removed of the particulate filter increases and thus the residual and deposited particulates are oxidized and removed more easily. If the air-fuel ratio in the exhaust gas is made rich immediately after the upstream side and the downstream side of the particulate filter is reversed by the valve body 71*a*, the other trapping surface on which the particulates do not remain releases active-oxygen more easily than the first trapping surface. Thus, the larger amount of released active-oxygen can oxidize and removed the residual particulates on the one trapping surface more certainly. Of course, the air-fuel ratio of the exhaust gas may be sometimes made rich regardless the changeover of the valve body 71*a*. Therefore, the particulates hardly remain or deposit on the particulate filter.

As a manner to make the air-fuel ratio rich, for example, low temperature combustion (refer to Japanese Patent No.3116876) may be carried out. The low temperature combustion can be carried out in an internal combustion engine in which, when an amount of inert gas in the combustion chamber is gradually increased, an amount of produced soot gradually increases and reaches a peak amount. In the low temperature combustion, an amount of inert gas in the combustion chamber is made larger than the amount of the inert gas when an amount of produced soot becomes the peak amount, and thus the temperature of the fuel and the gas around the fuel is suppressed to lower than a temperature that soot is produced, and therefore the production of soot is suppressed in the combustion chamber. Further, to make the air-fuel ratio of the exhaust gas rich, the combustion air-fuel ratio may be merely made rich. Further, in addition to the main fuel injection in the compression stroke, the fuel injector may inject fuel into the cylinder in the exhaust stroke or in the expansion stroke (post-injection), or may inject fuel into the cylinder in the intake stroke (pre-injection). Of course, an interval between the post-injection or the pre-injection and the main fuel injection may not be provided. Further, fuel may be supplied to the exhaust system.

Thus, when the above-mentioned active-oxygen releasing agent is carried on the particulate filter 70, the particulates trapped on the particulate filter 70 can be oxidized and removed and $NO_X$ in the exhaust gas, of which emission into the atmosphere is undesirable, can be absorbed in the particulate filter. By the way, the ability for absorbing $NO_X$ in the active-oxygen releasing agent has a limit. In the present embodiment, it is intended that the particulate filter purifies $NO_X$, i.e., the particulate filter functions as a device for purifying $NO_X$. In this case, if the ability saturates, the active-oxygen releasing agent cannot newly absorb $NO_X$ in the exhaust gas and thus $NO_X$ cannot be favorably purified. Accordingly, before the ability saturates, $NO_X$ must be released from the active-oxygen releasing agent. Namely, before a current amount of $NO_X$ absorbed in the particulate filter 70 reaches the limit amount of $NO_X$ that can be absorbed therein, a regeneration process of the particulate filter, in which $NO_X$ is released therefrom and the released $NO_X$ is reduced and purified, is required. Thus, if $NO_X$ is released at one time, a large amount of active-oxygen also is released simultaneously. This is advantage for oxidizing and removing the trapped particulates.

For this purpose, a current amount of $NO_X$ absorbed in the particulate filter 70 must be estimated. In the present embodiment, an amount of $NO_X$ absorbed in the particulate filter per a unit time (A) in the low temperature combustion can be determined as functions of a required load (L) and an engine speed (N) and thus a map of the amounts of $NO_X$ (A) absorbed in the low temperature combustion is predetermined. An amount of $NO_X$ absorbed in the particulate filter per a unit time (B) in the normal combustion can be determined as functions of a required load (L) and an engine speed (N) and thus a map of the amounts of $NO_X$ (B) absorbed in the normal combustion is predetermined. Therefore, a current amount of $NO_X$ absorbed in the particulate filter can be estimated to integrate these amounts of $NO_X$ absorbed in the particulate filter per a unit time (A) and (B). Here, when the low temperature combustion takes place in a rich air-fuel ratio, the absorbed $NO_X$ is released and thus an amount of $NO_X$ absorbed in the particulate filter per a unit time (A) become a minus value.

Figure 12:
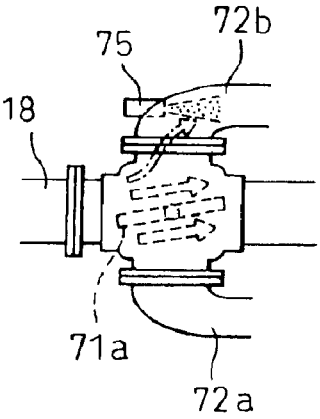
FIG. 12 is a view showing the position of the valve body in the changeover portion when $NO_X$ is released from the particulate filter.

In the present embodiment, when the estimated amount of $NO_X$ absorbed in the particulate filter becomes more than a predetermined permissible value, the second reducing material supply unit 75 arranged on the second connecting portion 72*b* inject fuel to regenerate the particulate filter 70. In this case, as shown in FIG. 12, the valve body 71*a* is pivoted slightly from the release position in the direction of the second shut-off position. Therefore, the valve body 71*a* does not shut off the changeover portion 71 and thus the exhaust gas mainly bypasses the particulate filter 70. However, a part of the exhaust gas flows in the second connecting portion 72*b*. Thus, the second reducing material supply unit 75 injects fuel into this slight amount of exhaust gas and the injected fuel flows in the particulate filter 70 therewith. Therefore, with a relatively small amount of fuel, an air-fuel ratio in the atmosphere surrounding the active-oxygen releasing agent can be made sufficiently rich. Accordingly, $NO_X$ is released from the particulate filter 70 and the released $NO_X$ is reduced and purified. The second reducing material supply unit 75 preferably injects fuel such that the injected fuel does not stick on the inside surface of the second connecting portion 72*b* and all of the injected fuel is used to make the air-fuel ratio in the surrounding atmosphere of the active-oxygen releasing agent on the particulate filter 70 rich. Besides, in the regeneration process of the particulate filter 70, the valve body 71*a* may assume the release position. Therefore, the exhaust gas does not flow in the particulate filter 70 and the fuel injected from the second reducing material supply unit 75 is supplied to the particulate filter by its inertia force.

If the fuel is supplied to the particulate filter 70 when the valve body 71*a* assumes the second shut-off position, a large amount of exhaust gas passes through the particulate filter 70 and thus the fuel with the large amount of exhaust gas easily passes through the particulate filter. Thus, if a large amount of fuel is not supplied, the air-fuel ratio in the surrounding atmosphere will not become rich and the particulate filter 70 will not be regenerated. The large amount of supplied fuel increases the fuel consumption while the fuel merely passing through the particulate filter 70 is emitted into the atmosphere to deteriorate the exhaust emission. Accordingly, as mentioned above, an amount of exhaust gas flowing in the particulate filter 70 is sufficiently decreased or is eliminated and thus the desired rich air-fuel ratio in the particulate filter 70 can be realized with a very small amount of fuel.

Thus, in the second reducing material supply unit 75, it is required that an amount of injected fuel per a unit time is controlled very small to realize the desired rich air-fuel ratio in the particulate filter 70. Accordingly, the injection hole thereof is made small or the fuel injection pressure therein is set low, and thus an intended small amount of fuel can be precisely injected. Besides, as the second reducing material supply unit 75, the combustion heater, that is used as an auxiliary heater for the inside of a vehicle immediately after the engine has started, can be used. The exhaust gas of the combustion heater includes a large amount of reducing material such as unburned HC and CO and thus the desired rich air-fuel ratio in the particulate filter 70 can be realized with this exhaust gas.

In this case, an amount of the exhaust gas of the combustion heater is controlled such that an amount of reducing material per a unit time supplied to the second connecting portion 72*b* becomes very small. The combustion heater generally comprises forced exhaust means. Therefore, when the exhaust gas is supplied to the second connecting portion 72*b* by using of the exhaust pressure of the forced exhaust means, the reducing material can be supplied to the particulate filter even if the flow of the exhaust gas in the second connecting portion 72*b* is eliminated with the valve body 71*a* in the release position. The unburned HC and CO included in the exhaust gas of the combustion heater are gases and thus they are burned in the particulate filter 70 by the noble metal catalyst more favorably than the liquid fuel supplied to the second connecting portion 72*b*. Therefore, the oxygen concentration therein sufficiently drops and the released $NO_X$ can be reduced and purified favorably.

By the way, in the particulate filter of the present embodiment as a device for purifying the particulates, the reverse means can reverse the exhaust gas upstream side and the exhaust gas downstream side thereof as mentioned above and thus the trapped particulates can be oxidized and removed relative favorably. However, a relatively large amount of particulates can deposit on the particulate filter due to many causes. As mentioned above, in the case that an amount of particulates deposited on the particulate filter is detected to utilize the difference in the pressure between the exhaust gas immediately upstream side and the exhaust gas immediately downstream side of the particulate filter, even if any engine operation patterns are carried out, the exhaust gas upstream side and the exhaust gas downstream side of the particulate filter is reversed when a predetermined amount of particulates is deposited. Thus, a relative large amount of particulates can hardly be deposited. However, in the case that the exhaust gas upstream side and the exhaust gas downstream side of the particulate filter is merely reversed regularly or irregularly, if an engine operation, in which a large amount of particulates is emitted, is carried out for a relative long period and immediately thereafter, an engine operation, in which the temperature of the exhaust gas is low, is carried out so that an amount of particulates that can be oxidized and removed with the temperature of the particulate filter drops, i.e., if an undesirable engine operation pattern for oxidizing and removing the particulates is carried out, a large amount of particulates may be deposited on the particulate filter.

If engine operation patterns are observed or if the drop of the engine output with an increase of the resistance of the exhaust gas of the particulate filter is detected, it can be estimated that a large amount of particulates is deposited on the particulate filter. When this is estimated, to oxidize and remove the deposited particulates, it is required that a relative large amount of reducing material such as fuel is supplied to the particulate filter, the oxidation function of the particulate filter makes the reducing material burn, and the burned heat makes the deposited particulates change into easily oxidized particulates and raises the temperature of the particulate filter to improve the amount of particulates that can be oxidized and removed.

When the reducing material is supplied to the particulate filter 70 to oxidize and remove the deposited particulates, the first reducing material supply unit 74 arranged upstream of the changeover portion 71 is used. An amount of reducing material per a unit time supplied by the first reducing material supply unit 74 is that to raise the temperature of the particulate filter 70 to the temperature causing the amount of particulates that can be oxidized and removed per a unit time required to oxidize and remove the current deposited particulates, on the basis that the larger the amount of the exhaust gas is, the larger the amount of reducing material that merely passes through the particulate filter 70 becomes. Namely, the larger the amount of exhaust gas is, the lower the temperature of the particulate filter 70 is, and the larger the amount of deposited particulates is, the larger the amount of reducing material per unit time is determined. The determined amount of reducing material per a unit time is the required minimum limit. Thus, when a current amount of exhaust gas is large or a current temperature of the particulate filter 70 is low, it is required that an amount of fuel injected by the first reducing material supply unit 74 per a unit time is kept very large to raise the temperature of the particulate filter 70. Accordingly, a size of the injection hole of the first reducing material supply unit 74 is made larger than that of the second reducing material supply unit 75 or an injection pressure of the first reducing material supply unit 74 is made higher than that of the second reducing material supply unit 75, and thus the first reducing material supply unit 74 can inject an intended large amount of fuel precisely. Of course, even if an amount of fuel larger than the required minimum amount of fuel is injected, the deposited particulates can be oxidized and removed, but the fuel consumption deteriorates.

The second reducing material supply unit 75 is suitable to precisely inject a small amount of reducing material and cannot inject a large amount of reducing material. In the present embodiment, the first reducing material supply unit 74 suitable to precisely inject a large amount of reducing material is provided separately from the second reducing material supply unit 75, to satisfy a requirement that reducing material changing from a very small amount to a very large amount is needed when the particulate filter 70 functions the device for purifying $NO_X$ and the particulates.

Besides, when a large amount of reducing material is supplied to the particulate filter 70, both of the first reducing material supply unit 74 and the second reducing material supply unit 75 may be used. In this case, the first reducing material supply unit 74 may not be suitable to inject a large amount of reducing material. Namely, the size of the injection hole of the first reducing material supply unit 74 may not always be larger than that of the second reducing material supply unit 75 or the injection pressure of the first reducing material supply unit 74 may not always be higher than that of the second reducing material supply unit 75. Thus, when a required minimum amount of reducing material that is large is supplied to the particulate filter 70, for example, the first reducing material supply unit 74 may supply a maximum or predetermined amount of reducing material and the second reducing material supply unit 75 may supply the amount of reducing material controlled so as to make up for a deficiency of the required minimum amount. At this time, if the temperature of the particulate filter 70 is observed, the amount of reducing material supplied by the second reducing material supply unit 75 can be feed-back controlled so as to raise the temperature of the particulate filter 70 to a desired temperature. In these cases, the amount of reducing material supplied by the first reducing material supply unit 74 can be made constant and thus it is not required to control it.

Thus, when the both of the first reducing material supply unit 74 and the second reducing material supply unit 75 are used to supply the reducing material to the particulate filter 70, the valve body 71*a* is required to assume the second shut-off position in the present embodiment. If the valve body 71*a* assumes the first shut-off position, the second reducing material supply unit 75 positioned downstream of the particulate filter 70 and cannot supply the reducing material to the particulate filter 70. Accordingly, it is required that the valve body 71*a* is changed over to the second shut-off position. However, in a case that the exhaust gas includes a relative large amount of particulates such as when the vehicle travels at a high speed or the like, if the valve body 71*a* is changed over into the second shut-off position to reverse the exhaust gas upstream side and the exhaust gas downstream side of the particulate filter 70, a part of the exhaust gas that bypasses the particulate filter during passing through the release position will emit a relative large amount of particulates into the atmosphere.

To prevent this, when a large amount of reducing material is supplied to the particulate filter 70, if the valve body 71*a* assumes the first shut-off position, it may be determined if the valve body 71*a* is changed over into the second shut-off position in accordance with a current amount of exhaust gas. Namely, when the current amount of exhaust gas is not larger than a predetermined amount, even if the valve body 71*a* is changed over into the second shut-off position, the exhaust gas will not make a large amount of deposited particulates separate from the particulate filter and it is estimated that an amount of particulates emitted into the atmosphere is smaller than a set amount. Therefore, at this time, the valve body 71*a* is changed over into the second shut-off position and the both of the first reducing material supply unit 74 and the second reducing material supply unit 75 supply the reducing material to the particulate filter 70. On the other hand, when the current amount of exhaust gas is larger than the predetermined amount, if the valve body 71*a* is changed over into second shut-off position, the exhaust gas will make a large amount of deposited particulates separate from the particulate filter and it is estimated that an amount of particulates emitted into the atmosphere is larger than the set amount. Therefore, at this time, the valve body 71*a* is not changed over into the second shut-off position and only the first reducing material supply unit 74 supplies the reducing material to the particulate filter 70.

In this case, if the maximum amount of reducing material supplied by the first reducing material supply unit 74 per a unit time is smaller than a minimum amount of reducing material required to oxidize and remove the deposited particulates per a unit time, the deposited particulates cannot be perfectly oxidized and removed, but can be reduced. Thus, when the deposited particulates are reduced, even if the valve body 71*a* is changed over into the second shut-off position, the exhaust gas will hardly make the deposited particulates separate from the particulate filter. Therefore, the valve body 71*a* is changed over into the second shut-off position and the both of the first reducing material supply unit 74 and the second reducing material supply unit 75 can supply the required amount of reducing material to the particulate filter 70.

By the way, when $SO_3$ exists, calcium Ca in the exhaust gas forms calcium sulfate $CaSO_4$. The calcium sulfate $CaSO_4$ is hardly oxidized and removed and it remains on the particulate filter as ash. To prevent the mesh-blocking of the particulate filter caused by calcium sulfate $CaSO_4$, an alkali metal or an alkali earth metal having an ionization tendency stronger than that of calcium Ca, such as potassium K may be used as the active-oxygen releasing agent 61. Therefore, $SO_3$ diffused in the active-oxygen releasing agent 61 is combined with potassium K to form potassium sulfate $K_2SO_4$ and thus calcium Ca is not combined with $SO_3$ but passes through the partition walls of the particulate filter. Accordingly, the meshes of the particulate filter are not blocked by the ash. Thus, it is desired to use, as the active-oxygen releasing agent 61, an alkali metal or an alkali earth metal having an ionization tendency stronger than calcium Ca, such as potassium K, lithium Li, cesium Cs, rubidium Rb, barium Ba or strontium Sr.

In the embodiment mentioned above, the particulate filter 70 carries an active-oxygen releasing agent that holds $NO_X$ to combine with the $NO_X$ with oxygen when excessive oxygen is present in the surrounding and is released to decompose the combined $NO_X$ and oxygen into $NO_X$ and active-oxygen when the oxygen concentration in the surrounding drops. Accordingly, the particulate filter 70 functions as a device for purifying the particulates in which the trapped particulates can be oxidized and removed and also functions as a device for purifying $NO_X$ in which $NO_X$ is absorbed and can be purified by reducing. Thus, the present particulate filter 70 is one in which a device for purifying the particulates and a device for purifying $NO_X$ are integrated.

However, this does not limit the present invention. For example, a device for purifying the particulates and a device for purifying $NO_X$ may be arranged separately in the exhaust system. In this case, while this exhaust system requires a small amount of reducing material for the device for purifying $NO_X$, it requires a large amount of reducing material for the device for purifying the particulates. One reducing material supply unit can satisfy this requirement. In also this case, at least two reducing material supply units may be arranged in the exhaust system. When a small amount of reducing material is required, one suitable for supplying a small amount of reducing material of the two reducing material supply units is used and thus the required amount of reducing material can be controlled precisely and supplied to the exhaust system. On the other hand, when a large amount of reducing material is required, both of the two reducing material supply units or one suitable for supplying a large amount of reducing material of the two reducing material supply units is used and thus the required amount of reducing material can be controlled precisely and supplied to the exhaust system.

In this case, any one of the device for purifying the particulates and the device for purifying $NO_X$ may be arranged upstream of the other in the exhaust system. The first reducing material supply unit and the second reducing material supply unit cannot supply the reducing material to the device for purifying the particulates or the device for purifying $NO_X$ which is arranged upstream thereof. Accordingly, to take this into consideration, the first reducing material supply unit and the second reducing material supply unit must be arranged so as to realize the intended reducing material supply.

As mentioned above, if the exhaust gas upstream side and the exhaust gas downstream side of the device for purifying the particulates can be reversed, the trapped particulates can be easily oxidized and removed. However, this does not limit the present invention. Even if the reversing means is not provided, when the trapped particulates are sufficiently oxidized and removed, both of the first reducing material supply unit and the second reducing material supply unit or the first reducing material supply unit supplies the reducing material to the device for purifying the particulates and thus an amount of particulates that can be oxidized and removed may be improved.

On the other hand, when $NO_X$ is released from the device for purifying $NO_X$, an amount of exhaust gas flowing into the device for purifying $NO_X$ is decreased by the bypass means. However, this does not limit the present invention. For example, when a flow rate of exhaust gas is small, $NO_X$ may be released from the device for purifying $NO_X$. Thus, an amount of reducing material supplied per a unit time can be reduced in the same way.

When the device for purifying $NO_X$ is provided with the bypass means, the second reducing material supply unit for supplying the reducing material to the device for purifying $NO_X$ must be arranged downstream of the branch portion of the bypass means.

Figure 13:
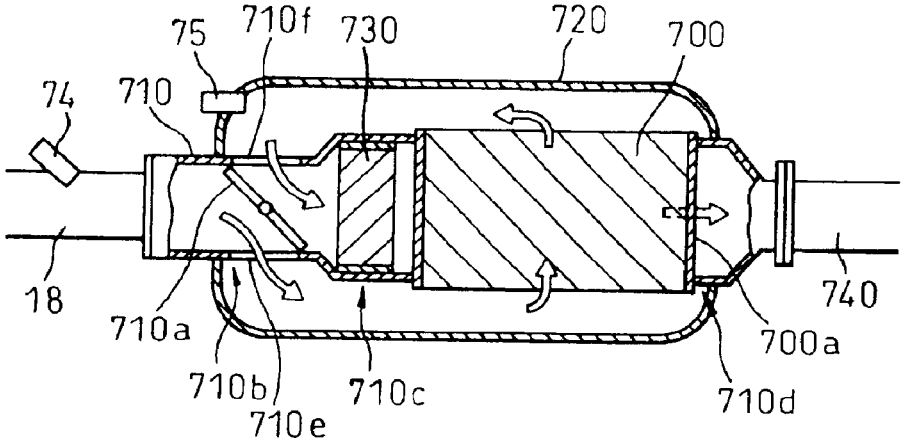
FIG. 13 is a sectional view showing another device for purifying the exhaust gas according to the present invention.
Figure 14:
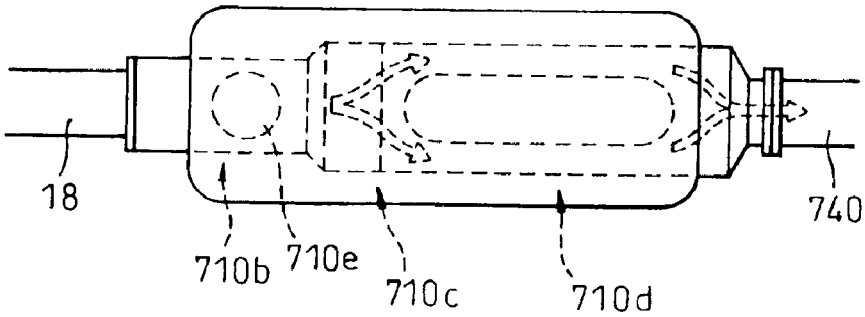
FIG. 14 is a side view of FIG. 13.
Figure 15:
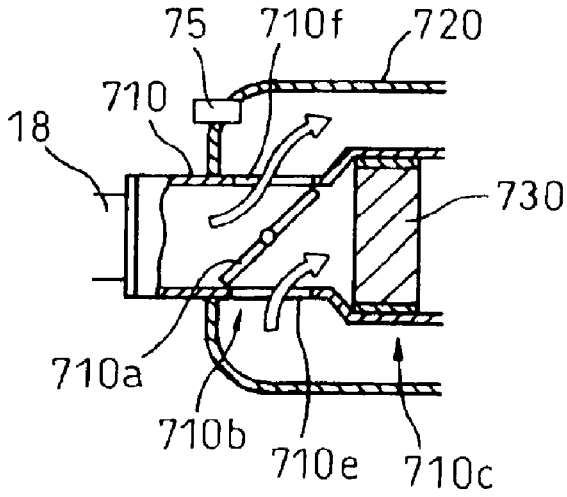
FIG. 15 is a view showing the other shut-off position of the valve body in the changeover portion that is different from that in FIG. 13.

FIG. 13 is a sectional view showing another device for purifying the exhaust gas, and FIG. 14 is a side view of FIG. 13. FIG. 15 is a sectional view showing the other shut-off position of the valve body that is different from that in FIG.

Figure 16:
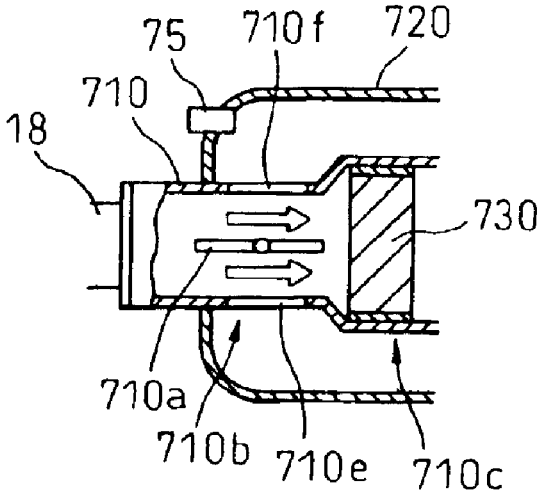
FIG. 16 is a view showing the release position of the valve body in the changeover portion in the device for purifying the exhaust gas of FIG. 13.

13, and FIG. 16 is a sectional view showing the release position of the valve body. The present device for purifying the exhaust gas has a center pipe member 710 and a cover member 720 surrounding the center pipe member 710. The upstream portion of the center pipe member 710 is connected to the downstream side of the exhaust manifold 17 via the exhaust pipe 18. The downstream portion of the center pipe member 710 is connected to the downstream exhaust pipe 740 that emits the exhaust gas into the atmosphere via a muffler. The center pipe member 710 comprises the upstream portion 710*b* in which the valve body 710*a* is arranged, the central portion 710*c* that is positioned immediately downstream of the upstream portion 710*b*, and the downstream portion 710*d* that is positioned immediately downstream of the central portion 710*c*.

On the side surface of the upstream portion 710*b*, the first opening 710*f* and the second opening 710*e* are formed to face each other. The valve body 710*a* can assume two shut-off positions to shut off the upstream portion 710*b* between the upstream side and the downstream side thereof. In the first shut-off position showing in FIG. 13, the upstream side of the upstream portion 710*b* and the first opening 710*e* are communicated and the downstream side of the upstream portion 710*b* and the second opening 710*f* are communicated. Besides, in the second shut-off position showing in FIG. 15, the upstream side of the upstream portion 710*b* and the second opening 710*f* are communicated and the downstream side of the upstream portion 710*b* and the first opening 710*e* are communicated.

In the central portion 710*d*, a catalytic unit 730 is arranged. Besides, the particulate filter 700 having the elliptic sectional shape as same as mentioned above with the outer case 700*a* thereof is arranged to penetrate the side surface of the downstream portion 710*d*.

According to such a construction, as shown by arrows in FIGS. 13 and 14, when the valve body 710*a* assumes the first shut-off position, the exhaust gas flows from the upstream side of the upstream portion 710*b* to the space between the center pipe member 710 and the cover member 720 via the first opening 710*e*, and after passing through the particulate filter 700, it flows to the upstream portion 710*b* via the second opening 710*f*. Thereafter, the exhaust gas passes through the catalytic unit 730 arranged in the central portion 710*c* and flows in the downstream portion 710*d* around the outer case 700*a* of the particulate filter 700 to the downstream exhaust pipe 740.

On the other hand, as shown by arrows in FIG. 15, when the valve body 710*a* assumes the second shut-off position, the exhaust gas flows from the upstream side of the upstream portion 710*b* to the space between the center pipe member 710 and the cover member 720 via the second opening 710*f*, and after passing through the particulate filter 700 in the reverse direction, it flows to the upstream portion 710*b* via the first opening 710*e*. Thereafter, the exhaust gas passes through the catalytic unit 730 arranged in the central portion 710*c* and flows in the downstream portion 710*d* around the outer case 700*a*of the particulate filter 700 to the downstream exhaust pipe 740.

Besides, as shown in FIG. 16, the valve body 710*a* can assume the release position between the first shut-off position and the second shut-off position. In the release position, the upstream portion 710*b* of the center pipe member 710 is opened and thus, as shown by arrows in FIG. 16, the exhaust gas does not flow in the space between the cover member 720 and the center pipe member 710, i.e., does not pass through the particulate filter 700, and flows directly in the catalytic unit 730 in the central portion 710*c*.

According to such a construction, the upstream portion 710*b* is a changeover portion similarly in the device for purifying the exhaust gas shown in FIGS. 2 and 3 and, thus, when the valve body 710*a* is changed over from one of the first shut-off position and the second shut-off position to the other, the exhaust gas upstream portion and the exhaust gas downstream portion of the particulate filter 700 can be reversed. Further, when the valve body 710*a* is in the release position, the exhaust gas can bypass the particulate filter 700. Besides, when the valve body 710*a* is pivoted slightly from the release position to the second shut-off position side, only a slight amount of exhaust gas can flow in the particulate filter 700.

Also in the present device for purifying the exhaust gas, the particulate filter 700 carries active-oxygen releasing agent as same as mentioned above. Thus, the particulate filter 700 functions as the device for purifying the particulates and as the device for purifying $NO_X$. The first reducing material supply unit 74 as same as mentioned above is arranged in the exhaust pipe 18. The second reducing material supply unit 75 as same as mentioned above is arranged in vicinity of the second opening 710*f* of the cover member 720 corresponding to the second connecting portion as mentioned above. Accordingly, the first reducing material supply unit 74 and the second reducing material supply unit 75 are used as mentioned above to supply the reducing material to the particulate filter 700.

In the present device for purifying the exhaust gas, the exhaust gas always passes through the catalytic unit 730 after bypassing the particulate filter 700 or after passing through the particulate filter 700 in any direction. If the catalytic unit 730 carries an oxidation catalyst, a reduction material such as HC, CO, or the like in the exhaust gas passing therethrough can be purified. In particular, in case that the reducing material is supplied to the particulate filter 700 when an amount of exhaust gas is large, even if a part of the supplied reducing material merely passes through the particulate filter, this reducing material can be favorably purified. Besides, the purification of reduction materials in the catalytic unit 730 corresponds to the burning of reduction materials and thus its burning heat heats the exhaust gas passing through the catalytic unit 730. Therefore, the exhaust gas of a relative high temperature passes around the particulate filter 700 as shown in FIG. 14 and thus the particulate filter 700 is heated to increase the amount of particulate that can be oxidized and removed from the particulates filter.

Even when only a noble metal such as platinum Pt is carried on the particulate filter as the active-oxygen releasing agent, active-oxygen can be released from $NO_2$ or $SO_3$ held on the surface of platinum Pt. However, in this case, a curve that represents the amount of particulates that can be oxidized and removed (G) is slightly shifted toward the right compared with the solid curve shown in FIG. 8. Further, when the device for purifying $NO_X$ is provided separately, the device for purifying the particulates always may not hold $NO_X$ and thus can use ceria as the active-oxygen releasing agent. The ceria absorbs oxygen when the oxygen concentration is high and releases active-oxygen when the oxygen concentration decreases. Therefore, in order to oxidize and remove the particulates, the air-fuel ratio of the exhaust gas must be made rich at regular intervals or at irregular intervals. Instead of the ceria, iron Fe or tin Sn can be used.

When the device for purifying the particulates is provided separately, the device for purifying $NO_X$ may carry an $NO_X$ absorbent, which will be explained below, and a noble metal catalyst as platinum Pt on the partition wall of a carrier having a honeycomb structure, by using an alumina or the like. In the present embodiment, the $NO_X$ absorbent is at least one selected from alkali metals such as potassium K, sodium Na, lithium Li, cesium Cs, and rubidium Rb, alkali earth metals such as barium Ba, calcium Ca, and strontium Sr, rare earth elements such as lanthanum La and yttrium Y, and transition metals. The $NO_X$ absorbent absorbs $NO_X$ when the air-fuel ratio (that is a ratio of the supplied air to the supplied fuel regardless of an amount of fuel burned by using oxygen in the supplied air) in the surrounding atmosphere is lean, and releases the absorbed $NO_X$ when the air-fuel ratio becomes stoichiometric or rich, and thus the $NO_X$ absorbent carries out the absorbing and releasing actions of $NO_X$. Of course, the particulate filter that functions as the device for purifying the particulates and the device for purifying $NO_X$ may carry any $NO_X$ absorbent in addition to any active-oxygen releasing agent.

The diesel engine in the above embodiments can change between the low temperature combustion and the normal combustion. However, this does not limit the present invention. Of course, the present invention also can be applied to the diesel engine carrying out only the normal combustion or the gasoline engine emitting particulates and $NO_X$.

Thus, according to the device for purifying the exhaust gas of the present invention, a device for purifying the particulates in the exhaust gas and a device for purifying $NO_X$ in the exhaust gas are integrally or separately comprised in the exhaust system. At least two reducing material supply units are arranged in the exhaust system to supply the reducing material to the device for purifying the particulates and the device for purifying $NO_X$. When the device for purifying the particulates or the device for purifying $NO_X$ requires a small amount of reducing material, one of the two reducing material supply units supplies the required amount of reducing material to the exhaust system. When the device for purifying the particulates or the device for purifying $NO_X$ requires a large amount of reducing material, the other of the two reducing material supply units, or both of them, supplies the required amount of reducing material to the exhaust system. Therefore, the one reducing material supply unit is selected to be suitable for supplying the small amount of reducing material and thus it can be realized that the small amount of reducing material is supplied precisely. On the other hand, the other reducing material supply unit is selected to be suitable for supplying the large amount of reducing material itself or with the one reducing material supply unit and thus it can be realized that the large amount of reducing material is supplied precisely. In the exhaust system comprising integrally or separately the device for purifying the particulates and the device for purifying $NO_X$, a range of a required amount of reducing material becomes very large. However, the two reducing material supply units can realize the very large control range, for the supplied amount, that satisfies this.

What is claimed is:

1. A device for purifying the exhaust gas of an internal combustion engine comprising a device for purifying the particulates in the exhaust gas and a device for purifying $NO_x$ in the exhaust gas integrally or separately in the exhaust system, wherein at least two reducing material supply means, for supplying the reducing material to said device for purifying the particulates and said device for purifying $NO_x$, are arranged in said exhaust system, when said device for purifying $NO_x$ requires a small amount of reducing material to purify $NO_x$, one of said two reducing material supply means supplies the required amount of reducing material to said exhaust system, and when said device for purifying the particulatesrequires a large amount of reducing material to oxidize and remove the particulates, both of said two reducing material supply means supply the required amount of reducing material to said exhaust system.

2. A device for purifying the exhaust gas of an internal combustion engine comprising a device for purifying the particulates in the exhaust gas and a device for purifying $NO_x$ in the exhaust gas integrally or separately in the exhaust system, wherein at least two reducing material supply means, for supplying the reducing material to said device for purifying the particulates and said device for purifying $NO_x$, are arranged in said exhaust system, when said device for purifying $NO_x$ requires a small amount of reducing material to purify $NO_x$, one of said two reducing material supply means supplies the required amount of reducing material to said exhaust system, and when said device for purifying the particulates requires a large amount of reducing material to oxidize and remove the particulates, the other of said two reducing material supply means supplies the required amount of reducing material to said exhaust system.

3. A device for purifying the exhaust gas of an internal combustion engine which includes separate devices for purifying the particulates in the exhaust gas and a device for purifying $NO_x$ in the exhaust gas located integrally or separately in the exhaust system, wherein at least two reducing material supply means, for supplying the reducing material to said device for purifying the particulates and said device for purifying $NO_x$, are arranged in said exhaust system, when said device for purifying the particulates or said device for purifying $NO_x$ requires a small amount of reducing material, one of said two reducing material supply means supplies the required amount of reducing material to said exhaust system, and when said device for purifying the particulates or said device for purifying $NO_x$ requires a large amount of reducing material, both of said two reducing material supply means supply the required amount of reducing material to said exhaust system, and wherein a bypass means, by which, if necessary, the exhaust gas can bypass said device for purifying $NO_x$ integrally with or separately from said device for purifying the particulate, is connected to said exhaust system via a branch portion and a joining portion, said one of said two reducing material supply means is arranged downstream of said branch portion in said exhaust system, and when $NO_x$ is released from said device for purifying $NO_x$, said bypass means makes an amount of exhaust gas passing through said device for purifying $NO_x$ decrease such that said device for purifying $NO_x$ requires said small amount of reducing material.

4. A device according to claim 3, wherein said two reducing material supply means are reducing material injection units, said one of said two reducing material supply means has a reducing material supply hole smaller than that of said other of said two reducing material supply means.

5. A device according to claim 3, wherein said device for purifying $NO_x$ is integral with said device for purifying the particulates.

6. A device according to claim 5, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

7. A device according to claim 3, wherein said one of said two reducing material supply means is a combustion heater.

8. A device according to claim 7, wherein said device for purifying $NO_x$ is integral with said device for purifying the particulates.

9. A device according to claim 8, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

10. A device according to claim 3, wherein said two reducing material supply means are reducing material injection units, said one of said two reducing material supply means has a reducing material injection pressure lower than that of said other of said two reducing material supply means.

11. A device according to claim 10, wherein said device for purifying $NO_x$ is integral with said device for purifying the particulates.

12. A device according to claim 11, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

13. A device according to claim 10, wherein said one of said two reducing material supply means is a combustion heater.

14. A device according to claim 13, wherein said device for purifying $NO_x$ is integral with said device for purifying the particulates.

15. A device according to claim 14, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

16. A device for purifying the exhaust gas of an internal combustion engine comprising a device for purifying the particulates in the exhaust gas and a device for purifying $NO_x$ in the exhaust gas integrally or separately in the exhaust system, wherein at least two reducing material supply means, for supplying the reducing material to said device for purifying the particulates and said device for purifying $NO_x$, are arranged in said exhaust system, when said device for purifying the particulates or said device for purifying $NO_x$ requires a small amount of reducing material, one of said two reducing material supply means supplies the required amount of reducing material to said exhaust system, and when said device for purifying the particulates or said device for purifying $NO_x$ requires a large amount of reducing material, the other of said two reducing material supply means supplies the required amount of reducing material to said exhaust system, and wherein a bypass means, by which, if necessary, the exhaust gas can bypass said device for purifying $NO_x$ intearally with or separately from said device for purifying the particulate, is connected to said exhaust system via a branch portion and a joining portion, said one of said two reducing material supply means is arranged downstream of said branch portion in said exhaust system, and when $NO_x$ is released from said device for purifying $NO_x$, said bypass means makes an amount of exhaust gas passing through said device for purifying $NO_x$ decrease such that said device for purifying $NO_x$ requires said small amount of reducing material.

17. A device according to claim 16, wherein said two reducing material supply means are reducing material injection units, said one of said two reducing material supply means has a reducing material supply hole smaller than that of said other of said two reducing material supply means.

18. A device according to claim 17, wherein said device for purifying $NO_x$ is integral with said device for purifying the particulates.

19. A device according to claim 18, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

20. A device according to claim 17, wherein said one of said two reducing material supply means is a combustion heater.

21. A device according to claim 20, wherein said device for purifying $NO_x$ is integral with said device for purifying the particulates.

22. A device according to claim 21, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

23. A device according to claim 16, wherein said two reducing material supply means are reducing material injection units, said one of said two reducing material supply means has a reducing material injection pressure lower than that of said other of said two reducing material supply means.

24. A device according to claim 23, wherein said device for purifying $NO_x$ is integral with said device for purifying the particulates.

25. A device according to claim 24, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

26. A device according to claim 23, wherein said one of said two reducing material supply means is a combustion heater.

27. A device according to claim 26, wherein said device for purifying $NO_x$ is integral with said device for purifying the particulates.

28. A device according to claim 27, wherein said bypass means comprises a valve body in a changeover portion, when said valve body assumes a release position to open in said changeover portion, the exhaust gas bypasses said device for purifying $NO_x$ integrally with said device for purifying the particulates, when said valve body assumes a first shut-off position to shut off in said changeover portion, the upstream portion in said changeover portion is communicated with one side of said device for purifying $NO_x$, the downstream portion in said changeover portion is communicated with the other side of said device for purifying $NO_x$ and thus the exhaust gas flows in said device for purifying $NO_x$ from said one side to said other side, when said valve body assumes a second shut-off position to shut off in said changeover portion, the upstream portion in said changeover portion is communicated with said other side of said device for purifying $NO_x$, the downstream portion in said changeover portion is communicated with said one side of said device for purifying $NO_x$ and thus the exhaust gas flows in said device for purifying $NO_x$ from said other side to said one side, and said one of said two reducing material supply means is positioned to supply the reducing material to said other side of said device for purifying $NO_x$.

29. A device for purifying the exhaust gas of an internal combustion engine comprising a device for purifying the particulates and $NO_x$ in the exhaust gas in the exhaust system wherein, at least two reducing material supply means for supplying the reducing material to said device are arranged in said exhaust system, reversing means for reversing the exhaust gas upstream side and the exhaust gas downstream side of said device is provided, said reversing means comprises a valve body in a changeover portion, when said valve body assumes a release position to open in said changeover portion, the exhaust gas bypasses said device, when said valve body assumes a first shut-off position to shut off in said changeover portion, the upstream portion in said changeover portion is communicated with one side of said device, the downstream portion in said changeover portion is communicated with the other side of said device and thus the exhaust gas flows in said device from said one side to said other side, when said valve body assumes a second shut-off position to shut off in said changeover portion, the upstream portion in said changeover portion is communicated with said other side of said device, the downstream portion in said changeover portion is communicated with said one side of said device and thus the exhaust gas flows in said device from said other side to said one side, one of said two reducing material supply means is positioned between said changeover portion and said other side of said device in said exhaust system, the other of said two reducing material supply means is positioned upstream of said changeover portion in said exhaust system, when said device requires a small amount of reducing material, said one of said two reducing material supply means supplies the reducing material to said exhaust system, when said device requires a large amount of reducing material and said valve body assumes said second shut-off position, both of said two reducing material supply means supply the reducing material to said exhaust system, and when said device requires said large amount of reducing material and said valve body assumes said first shut-off position, if it is estimated that an amount of particulates smaller than a predetermined amount is emitted from said device when said valve body is changed over to said second shut-off position, both of said two reducing material supply means supply the reducing material to said exhaust system after said valve body is changed over to said second shut-off position, if it is estimated that an amount of particulates equal to or larger than said predetermined amount is emitted from said device when said valve body is changed over to said second shut-off position, said valve body is not changed over to said second shut-off position and said other of said two reducing material supply means supplies the reducing material to said exhaust system.

* * * * *